US012195246B2

(12) United States Patent
Hoefte et al.

(10) Patent No.: US 12,195,246 B2
(45) **Date of Patent: *Jan. 14, 2025**

(54) DETERGENT PRODUCT CONTAINER WITH LOCK

(71) Applicant: The Procter & Gamble Company, Cincinnati, OH (US)

(72) Inventors: Paulus Antonius Augustinus Hoefte, Astene (BE); Clara Sophie Lea Ng Pak Leung, Ixelles (BE)

(73) Assignee: The Procter & Gamble Company, Cincinnati, OH (US)

( * ) Notice: Subject to any disclaimer, the term of this patent is extended or adjusted under 35 U.S.C. 154(b) by 15 days.

This patent is subject to a terminal disclaimer.

(21) Appl. No.: 17/883,094

(22) Filed: Aug. 8, 2022

(65) Prior Publication Data

US 2022/0380086 A1 Dec. 1, 2022

Related U.S. Application Data

(63) Continuation of application No. PCT/US2021/061158, filed on Nov. 30, 2021.

(30) Foreign Application Priority Data

Dec. 11, 2020 (EP) ..... 20213631

(51) Int. Cl.
*B65D 5/68* (2006.01)
*B65D 5/02* (2006.01)
(Continued)

(52) U.S. Cl.
CPC ..... *B65D 5/685* (2013.01); *B65D 5/02* (2013.01); *B65D 5/563* (2013.01); *B65D 5/6608* (2013.01);
(Continued)

(58) Field of Classification Search
CPC ..... B65D 5/685; B65D 5/02; B65D 5/563; B65D 81/364; B65D 2543/00101;
(Continued)

(56) References Cited

U.S. PATENT DOCUMENTS 1,130,271 A 3/1915 Hammond
2,412,402 A 12/1946 Huye
(Continued)

FOREIGN PATENT DOCUMENTS

AT 334276 B 1/1976
CH 710519 A2 6/2016
(Continued)

OTHER PUBLICATIONS

All Office Actions; U.S. Appl. No. 17/689,146, filed Mar. 8, 2022.
(Continued)

*Primary Examiner* — Christopher R Demeree
(74) *Attorney, Agent, or Firm* — Andrew J. Mueller; Gary J. Foose

(57) ABSTRACT

Examples include a consumer product comprising a box comprising a detergent product, a lid and a lock. The lid comprises flanks covering a specific portion of a sidewall of the box. The lock comprises a specific actuator moveable by applying an actuation pressure, the specific actuator being connected to the specific portion, the flanks comprising a specific actuation area facing the specific actuator and permitting displacing it by applying the actuation pressure.

20 Claims, 4 Drawing Sheets

(51) Int. Cl.

| | |
|---|---|
| ***B65D 5/56*** | (2006.01) |
| ***B65D 5/66*** | (2006.01) |
| ***B65D 43/02*** | (2006.01) |
| ***B65D 50/04*** | (2006.01) |
| ***B65D 81/26*** | (2006.01) |

(52) U.S. Cl.
CPC ..... *B65D 43/0233* (2013.01); *B65D 50/046* (2013.01); *B65D 81/264* (2013.01); *B65D 2215/02* (2013.01); *B65D 2251/04* (2013.01); *B65D 2543/00101* (2013.01); *B65D 2543/00268* (2013.01); *B65D 2543/00537* (2013.01); *B65D 2543/00574* (2013.01)

(58) Field of Classification Search
CPC ..... B65D 2543/00268; B65D 2543/00537; B65D 2543/00574; B65D 5/106; B65D 5/6667; B65D 5/68; B65D 55/02
USPC ..... 229/125.19, 125.26, 125.28, 160.2, 102, 229/122.32, 145, 148, 120.13, 125.27, 229/125.39; 206/815, 807
See application file for complete search history.

(56) References Cited

U.S. PATENT DOCUMENTS

| | | | | |
|---|---|---|---|---|
| 2,456,841 | A | 12/1948 | Rushing | |
| 2,559,320 | A | 7/1951 | Rushing et al. | |
| 2,615,613 | A | 10/1952 | Reeser | |
| 2,711,282 | A | 6/1955 | Julian | |
| 2,745,589 | A | 5/1956 | Daly et al. | |
| 2,777,630 | A | 1/1957 | Moberger | |
| 3,116,007 | A | 12/1963 | D'Esposito et al. | |
| 3,275,219 | A | 9/1966 | Mckechnie | |
| RE26,557 | E | 3/1969 | Houston | |
| 3,512,699 | A | 5/1970 | Wilson | |
| 3,692,231 | A | 9/1972 | Neitzke et al. | |
| 3,971,505 | A | 7/1976 | Ohkubo | |
| 4,053,100 | A | 10/1977 | Baptist | |
| 4,196,843 | A | 4/1980 | Garmon | |
| 4,304,355 | A | 12/1981 | Sykora | |
| 4,531,669 | A | 7/1985 | Osborne | |
| 5,040,722 | A | 8/1991 | Fromion et al. | |
| 5,050,794 | A | 9/1991 | Wischusen, III | |
| 5,148,973 | A | 9/1992 | Zimmermann | |
| 5,161,734 | A | 11/1992 | Ruehl et al. | |
| 5,205,477 | A | 4/1993 | Zimmermann | |
| 6,296,175 | B1 | 10/2001 | Dixon | |
| 6,484,931 | B1 | 11/2002 | Hoefte | |
| 6,604,676 | B2 | 8/2003 | Giblin | |
| 7,658,318 | B2 * | 2/2010 | Walsh | B65D 5/744 229/231 |
| 7,726,552 | B2 | 6/2010 | Chadima | |
| 9,352,888 | B2 * | 5/2016 | Scott | B65D 55/02 |
| 9,783,335 | B2 | 10/2017 | Everett | |
| 9,881,788 | B2 | 1/2018 | Kim et al. | |
| 9,981,788 | B2 | 5/2018 | Skinner | |
| 10,017,291 | B2 | 7/2018 | Smith et al. | |
| 10,913,568 | B2 * | 2/2021 | Sollie | B65D 5/12 |
| D911,837 | S * | 3/2021 | Sollie | D9/434 |
| 10,934,072 | B2 | 3/2021 | Lantz et al. | |
| 11,482,582 | B2 | 10/2022 | Li | |
| 11,794,947 | B2 | 10/2023 | Hoefte et al. | |
| 11,851,232 | B2 | 12/2023 | Leonie | |
| 2003/0222130 | A1 | 12/2003 | Fukushima et al. | |
| 2008/0054059 | A1 | 3/2008 | Chadima | |
| 2015/0136619 | A1 | 5/2015 | Scott | |
| 2016/0251107 | A1 | 9/2016 | Everett | |
| 2016/0340068 | A1 | 11/2016 | Brandt Sanz | |
| 2017/0036808 | A1 | 2/2017 | Everett | |
| 2017/0355935 | A1 | 12/2017 | Courchay et al. | |
| 2018/0022498 | A1 | 1/2018 | Everett | |
| 2018/0257827 | A1 | 9/2018 | Drosos et al. | |
| 2019/0062023 | A1 | 2/2019 | Lantz et al. | |
| 2019/0135503 | A1 | 5/2019 | De Wilde | |
| 2021/0047072 | A1 | 2/2021 | Ng Pak Leung et al. | |
| 2021/0347524 | A1 | 11/2021 | Hoefte et al. | |
| 2022/0009671 | A1 | 1/2022 | Hoefte et al. | |
| 2022/0081155 | A1 | 3/2022 | Hoefte et al. | |
| 2022/0185534 | A1 | 6/2022 | Hoefte et al. | |
| 2022/0289436 | A1 | 9/2022 | Hoefte et al. | |
| 2023/0103439 | A1 | 4/2023 | Hoefte et al. | |
| 2023/0110630 | A1 | 4/2023 | Hoefte et al. | |
| 2023/0132541 | A1 | 5/2023 | Hoefte et al. | |
| 2023/0227186 | A1 | 7/2023 | Ruers et al. | |
| 2023/0257141 | A1 | 8/2023 | Ruers et al. | |
| 2023/0257145 | A1 | 8/2023 | Ruers et al. | |
| 2023/0264852 | A1 | 8/2023 | Hoefte et al. | |
| 2023/0264853 | A1 | 8/2023 | Hoefte et al. | |
| 2023/0286695 | A1 | 9/2023 | Hoefte et al. | |
| 2023/0322455 | A1 | 10/2023 | Beelen et al. | |
| 2023/0331447 | A1 | 10/2023 | Hoefte et al. | |
| 2024/0002100 | A1 | 1/2024 | Hoefte et al. | |
| 2024/0076074 | A1 | 3/2024 | Ruers | |

FOREIGN PATENT DOCUMENTS

| | | | |
|---|---|---|---|
| CN | 1388043 | A | 1/2003 |
| DE | 9214914 | U1 | 1/1993 |
| DE | 202005017363 | U1 | 3/2007 |
| EP | 0454506 | A1 | 10/1991 |
| EP | 1783058 | A1 | 5/2007 |
| EP | 2808265 | A1 | 12/2014 |
| EP | 3261941 | A1 | 1/2018 |
| EP | 3587293 | A1 | 1/2020 |
| EP | 3443059 | B1 | 5/2020 |
| EP | 3753856 | A1 | 12/2020 |
| EP | 3907149 | A1 | 11/2021 |
| EP | 4163219 | A1 | 4/2023 |
| EP | 4245676 | A2 | 9/2023 |
| FR | 2646830 | A1 | 11/1990 |
| FR | 3020349 | A1 | 10/2015 |
| GB | 1173046 | A | 12/1969 |
| GB | 2358391 | A | 7/2001 |
| JP | H728015 | U | 5/1995 |
| JP | 03055362 | U | 1/1999 |
| JP | 2000118528 | A | 4/2000 |
| JP | 2001315767 | A | 11/2001 |
| JP | 2002104382 | A | 4/2002 |
| JP | 2004035049 | A | 2/2004 |
| JP | 2004250071 | A | 9/2004 |
| JP | 2006160299 | A | 6/2006 |
| JP | 2007084129 | A | 4/2007 |
| JP | 2008265010 | A | 11/2008 |
| JP | 2009029481 | A | 2/2009 |
| JP | 4536881 | B2 | 6/2010 |
| JP | 2014227194 | A | 12/2014 |
| WO | 2005102849 | A1 | 11/2005 |
| WO | 2006003387 | A1 | 1/2006 |
| WO | 2009024772 | A2 | 2/2009 |
| WO | 2011154822 | A1 | 12/2011 |
| WO | 2018022493 | A1 | 2/2018 |
| WO | 2019144244 | A1 | 8/2019 |

OTHER PUBLICATIONS

All Office Actions; U.S. Appl. No. 17/883,108, filed Aug. 8, 2022.
All Office Actions; U.S. Appl. No. 17/543,883, filed Dec. 7, 2021.
PCT Search Report and Written Opinion for PCT/US2021/061158 dated Apr. 3, 2022,13 pages.
Extended EP Search Report and Written Opinion for 22185324.5 dated Dec. 23, 2022, 5 pages.
Extended EP Search Report and Written Opinion for 20213631.3 dated May 18, 2021, 7 pages.
Unpublished U.S. Appl. No. 17/883,108, filed Aug. 8, 2022, to Paulus Antonius Augustinus Hoefte et. al.
All Office Actions; U.S. Appl. No. 18/207,262, filed Jun. 8, 2023.
Unpublished U.S. Appl. No. 18/207,262, filed Jun. 8, 2023, to Paulus Antonius Augustinus Hoefte et al.
Unpublished U.S. Appl. No. 18/506,351, filed Nov. 10, 2023, to Henri Theo Leonie Ruers et al.

(56) References Cited

OTHER PUBLICATIONS

All Office Actions: U.S. Appl. No. 18/310,031, filed May 1, 2023.
Extended EP Search Report and Written Opinion for 23188113.7 dated Dec. 6, 2023, 7 pages.
PCT Search Report and Written Opinion for PCT/US2022/015412 dated Apr. 5, 2022,12 pages.
Extended EP Search Report and Written Opinion for 21156133.7 dated Jul. 15, 2021, 07 pages.
PCT Search Report and Written Opinion for PCT/US2021/061159 dated Mar. 4, 2022,10 pages.
EPO Search Report and Opinion for 23182460.8 dated Nov. 23, 2023, 6 pages.
Extended EP Search Report and Search Opinion for EP21162534.8 dated Aug. 26, 2021, 7 pages.
PCT Search Report and Written Opinion for PCT/US2021/015414 dated Jun. 10, 2022,11 pages.
Extended EP Search Report and Written Opinion for 21162533.0 dated 26.08.21, 06 pages.
PCT Search Report and Written Opinion for PCT/US2022/015415dated Jun. 1, 2022, 17 pages.
Extended European search report and search opinion for Application No. 21156127.9, dated Sep. 3, 2021, 11 pages.
Third Party Observation for 21156127.9 dated Feb. 7, 2023, 10 pages.
Unpublished U.S. Appl. No. 18/469,978, filed Sep. 19, 2023, to Paulus Antonius Augustinus Hoefte et al.
EPO Search Report and Search Opinion for Application No. 23188116.0, dated Dec. 12, 2023, 7 pages.
EPO Search Report and Search Opinion for Application No. 23193196.5, dated Jan. 15, 2024, 7 pages.
Size data of the hands of Kochi, AIST and AIST persons, L01-N15, Online retrieved from "https://www.airc.aist.go.jp/dhrt/hand/index.html", 2012, 6 Pages.
"3in1 Colour Laundry Detergent Capsules", Mintel, ID 6895089, Sep. 2019, 3 Pages.
"Biological Laundry Liquid Tablets", Mintel, ID 2652253, Sep. 2014, 3 Pages.
"Fresh Waterfall Scented Detergent Capsules", Mintel, ID 6648121, Jun. 2019, 3 Pages.
Ariel 3-in-1 pouch safety data sheet, P&G, dated Jun. 21, 2019, 9 Pages.
Ariel all-in-1 colour pouch safety data sheet, P&G, dated Dec. 20, 2019, 11 Pages.
Commercial unit dose detergent pouch calculations and measured data, Year 2020, 4 Pages.
Henkel Persil Discs Sensitive pouch safety data sheet, 2020, 48 Pages.

* cited by examiner

DETERGENT PRODUCT CONTAINER WITH LOCK

BACKGROUND

This invention generally relates to containers for detergent products. Such containers containing detergent products are consumer products present in consumer homes, in particular in rooms such as a kitchen, a laundry room or a bathroom, which tend to generate a humid environment. It is important that the container be configured to adequately protect the detergent product from degradation due to an excessive exposure to such moisture or humidity.

DETAILED DESCRIPTION

Figure 1:
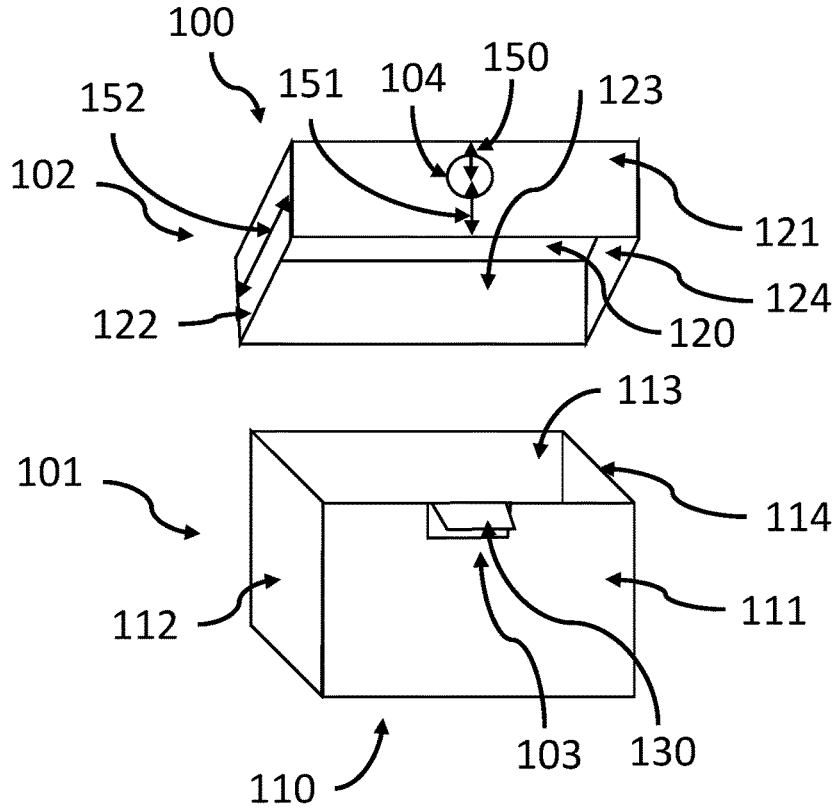
FIG. 1 illustrates a first example consumer product.

Detergent products are sensitive to humidity and should as such be contained in specific containers, in particular containers which may be locked to reduce risks of an accidental opening. At the same time, a lock of such a container should be configured to be actuated by an ample variety of adult consumers or users. The lock should thereby both reliably prevent accidental opening and provide for reliable unlocking when desired by an adult consumer. While such objectives may appear contradictory, it is important to get them both resolved. This apparent contradiction is particularly acute when applied to cardboard containers which, while offering desirable recyclability, introduce challenges related to their mechanical characteristics. The consumer product according to this disclosure aims at taking these different aspects into account.

As will be described below, the specific configuration described in this disclosure permits relying on a specific human gesture called "precision pinch". Precision pinch is a specific human hand gesture whereby a human pinches an object between thumb and at least one or more other finger of the same hand. It was found that human beings are particularly precise when exerting such a movement. Precision may be described in this respect by considering the alignment of the direction of forces applied by the thumb and by the one or more other fingers of the same hand. When applying a precision pinch, the thumb generates a first force on a first side of the pinch, the one or more other finger generating a second force on a second side of the pinch. Generally speaking, the first and the second forces are substantially along the same axis, in opposite senses. The key point of the precision pinch is that the first and the second force will naturally align each other if there is a reciprocal feedback response between the thumb and the one or more other fingers from the same hand. As will be described below, the configurations proposed will enable such reciprocal feedback, leading to relying on a precision permitting reliable lock opening of an otherwise robust locking mechanism. As will be described below, specific dimensioning enables such configurations, in particular corresponding to an adult hand. It should indeed be understood that, in the present description, a hand corresponds to a human adult hand.

Detergent products are products which may be relatively heavy, for example when a container for such product is carrying the full weight of such detergent products, in particular when the consumer product is recently acquired and thereby holds a significant quantity of detergent product. While some consumers may lift and transport such a consumer product holding a base of a box containing such detergent product, such lifting and transport may also occur by holding such consumer product by a lid, without holding the base. In such cases, it is possible that the lid, submitted to the force of gravity of the detergent product, gets released and opens the box, the box falling and possibly spreading its content. Such situations should be avoided. Beyond avoiding such unintentional lid unlocking, the structure of the container of a consumer product should preserve or improve opening ergonomics and prevent or reduce a permanent side wall deformation upon excessive or repetitive application of forces applied to the consumer product, for example during transport, in a grocery shopping bag against other objects, when submitted to external pressure, or when dropped. At the same time, containers may be elaborated in order to preserve the environment. The consumer product according to this disclosure aims at taking these different aspects into account.

A consumer product should in this disclosure be understood as a product which is provided, among others, to end consumers. Such consumer products may for example be available for purchase in supermarkets and end consumers may store such consumer products in their homes. Consumer products may be provided in large quantities and should thereby be designed taking environmental concerns into account. Consumer products should also be designed taking transportation to a retail store into account. Consumer products should also be robust to withstand transportation as part of an e-commerce shipment. Consumer products should also be designed taking on the shelf storage in a retail store into account. Consumer products should also be designed taking transportation from a retail store to a consumer home into account. Consumer products should also be designed taking storage at a private end-consumer home into account. Consumer products should also be designed taking use of the consumer product at a private end consumer home into account. Consumer products should also be designed taking disposal into account.

The consumer product according to this disclosure comprises a detergent product. Detergent products should be understood in this disclosure as products comprising a surfactant. Detergent products may also comprise a bleach or other ingredients. Example detergent product compositions are described in more detail herein. In some examples, the detergent product comprises unit dose detergent pouches, preferably water soluble unit dose detergent pouches, more preferably flexible water soluble unit dose detergent pouches. Example unit dose detergent pouches are described in more detail herein.

The consumer product according to this disclosure further comprises a container. A container should be understood in this disclosure as an object housing a content, for example in a cavity of the container. The container facilitates protection, transport, storage, access and disposal of the consumer product.

In this disclosure, the container comprises a box. A box should be understood as a generally parallelepiped, barrel shaped, cylindrical, round, oval or cubical three dimensional object defining a cavity. The use of parallelepiped boxes may facilitate storage and transportation by permitting piling up boxes in a space efficient manner. In some examples, a box may be a parallelepiped provided with some rounded, tapered trapezium or chamfered edges. The box according to this disclosure comprises the detergent product. It should be understood that the detergent product is contained or stored in the box. The box according to this disclosure comprises a base, sidewalls and an opening opposite the base. A base according to this disclosure should be understood as a surface on which the box may lie when placed on a supporting surface such as a shelf or a floor. In some examples, the base is flat. In some examples, the base is rectangular. In some examples, the base is oval or round. In some examples, the base has an embossed profile standing in or out in relief. The sidewalls according to this disclosure should be understood as extending from the base, and connecting the base to the opening, to a transition piece or to the lid. It should be understood that the connection of the base to the opening may include one or more transition pieces in addition to a sidewall. A transition piece may be glued or otherwise attached to the sidewall for example. In some examples, the sidewalls are perpendicular to the base. In some examples, the base is rectangular and has four sides, four sidewalls extending perpendicular from the base, each sidewall being rectangular, each side wall being connected by a sidewall side to a side of the base, and by two other sidewall sides to two other of the four sidewalls. In some examples the base is oval or circular and the sidewalls form a generally cylindrical wall extending from the base in a direction normal or perpendicular to the base. In some examples, sidewalls have a shape corresponding to one of a square, a rectangle, a trapeze, a polygon, a section of a sphere, a section of an ovoid, or a section of an ellipsoid. The opening according to this disclosure should be understood as an aperture providing access to the detergent product comprised in the box. In some examples, the opening faces the base. In some examples, the opening has a surface of less than the surface of the base. In some examples, the opening has a surface larger than the surface of the base in order to provide an improved access, for example using sidewalls extending from the base at angle of more than 90 degrees from the base. In some examples, the opening is provided after removal of a tamper proof feature, for example comprising a perforated piece to be removed at first use or a tamper evident sticker locking a lid to the box. In some examples a tamper evident sticker is glued on the lid and on the box, whereby the tamper evident sticker should be broken, teared or perforated at first opening to indicate to a consumer that the container has not been tempered with before purchase. This temper evident sticker may for example be in paper or in plastic. In some examples, the opening is placed on a top panel of the box, the top panel of the box facing, i.e. opposite, the base of the box, the top panel of the box being separated from the base of the box by at least the sidewalls, the top panel of the box being generally coplanar with the base of the box, whereby the opening covers a portion of the top panel, the top panel comprising a peripheral section surrounding the opening, the peripheral section being a transition piece between a sidewall and the opening for example. In some examples, the opening is rectangular. In some examples, the opening is rectangular with rounded edges. In some examples, the opening is round or oval.

The container comprises a lid for the box. The lid according to this disclosure should be understood as an element permitting to repeatedly close or open the opening of the box. In some examples the lid may be connected to the box, for example by a hinge, or may be separated from the box. The lid according to this disclosure comprises a top or lid top and flanks or lid flanks. It should be understood that the top of the lid is aimed at covering the opening of the box when the lid is in a closed position. In some examples, the top of the lid is rectangular. In some examples the top of the lid is round, hexagonal, octagonal, polygonal or oval, structures such as round or oval being for example approximated by multiplying a number of side panels and lid flaps. In some examples, the lid comprises beveled edges. In some examples, the top of the lid is rectangular with rounded edges. It should be understood that while being named "top", the top of the lid may be positioned in different orientations. The lid comprises flanks. It should be understood that the flanks according to this disclosure are elements connected to the top of the lid and extending from the lid in order to engage one or more sidewalls of the box, each flank having an extension along a corresponding sidewall between the connection to the top of the lid and a distal end of the flank. The flanks participate in placing the top of the lid onto the opening. In some examples, the flanks extend perpendicularly from the top of the lid. In some examples, the flanks surround an entire perimeter of the top of the lid. In some examples, the flanks partially surround an entire perimeter of the top of the lid, a portion of the top of the lid being flankless, for example along a hinge between the lid and the box in a case of a hinged lid. The top of the lid may cover the opening, and at least a portion of the flanks may cover at least a specific portion of a specific sidewall of the sidewalls of the box when the lid is in the closed position, the lid being moveable from the closed position to an open position. Movement of the lid may be restrained by a connection to the box such as a hinge, or may be entirely removable, for example to provide an improved access to the content of the box. The box and lid cooperate to participate in fulfilling the role of the container to store, transport and facilitate access to the content of the container.

The container according to this disclosure comprises a lock. A lock should be in this disclosure understood as a mechanism preventing or reducing the likelihood of an accidental opening. The lock according to this disclosure is to maintain the lid in a closed position. It should be understood that the lock according to this disclosure is expected to function under normal use of the container. It should be understood that the lock may not fulfill its function when for example unusual use is made of the box, or when the box is under unusual conditions. According to this disclosure, the lock comprises a specific actuator moveable from a locking position to an opening position by applying an actuation pressure onto the specific actuator when the lid is in the closed position. The specific actuator should be understood in this disclosure as a mechanical structure submitted to a movement upon actuation by an outside force or actuation pressure, such movement leading to the opening of the lock when such movement takes place. In some examples, the specific actuator according to this disclosure is resilient and has a default position, such default position corresponding to the lid remaining closed, a resilience being vanquished by an outside force or actuation pressure in order to open the lid. In some examples, the specific actuator is resilient in that the specific actuator comprises a flexible element, the flexible element having a default position corresponding to the lid remaining closed, the flexible element being pressed to open the lid, the flexible element springing back to the default position when releasing pressure. It should be understood that a pressure is generated by the application of a force onto a surface. The specific actuator according to this disclosure has at least two positions being the opening position and the locking position, whereby the opening position corresponds to a position permitting opening of the lid, the locking position preventing opening of the lid or reducing the possibility of an accidental opening of the lid.

The specific actuator according to this disclosure is connected to the specific portion being the at least specific portion of a specific sidewall of the sidewalls of the box covered by at least a portion of the flanks when the lid is in the closed position, which may be a specific portion covered by at least a portion of the flanks when the lid is in the closed position, the specific actuator abutting for example against a locking tab of the flanks when in the locking position, the specific actuator being for example maintained away from the locking tab when in the opening position, the specific actuator being for example displaceable by the actuation pressure by an unlocking displacement distance in a direction normal to the specific portion of the sidewalls. The connection to the specific portion may for example be a fold line at an end of a sidewall away from the base. The connection of the specific actuator to the specific portion of the sidewall is due to the specific actuator participating in locking or unlocking the specific portion of the sidewall from the portion of the flanks covering the specific portion of the sidewall, thereby permitting releasing the lid from the box. The flanks may comprise a locking tab. A locking tab should be understood as a mechanical element which interlocks with the specific actuator. In some examples the locking tab extends away from the flanks and may be in the form of a bulge, a ridge, an embossment or an additional material layer sticking out of the flanks of the lid and towards the specific portion of the side wall such that the specific actuator may abut against the tab when in the locking position to prevent separating the specific portion of the sidewalls from the flank in the area of the specific actuator. In some examples, the locking tab is comprised in the flank itself, the locking tab being for example formed by an aperture in the flanks. Abutment according to this disclosure should be understood as a contact between the specific actuator or part of the specific actuator and the tab, such contact preventing opening of the lid. In some examples the specific actuator is maintained away from the locking tab when in the opening position, in order to release the locking tab. Such release of the locking tab permits opening the lid. Displacement or movement of the specific actuator from the locking to the opening position is by application on the specific actuator (directly or indirectly) of an actuation pressure or force such that the specific actuator is displaced by a distance sufficient to suppress contact of the specific actuator with the locking tab, such distance corresponding to the displacement distance, in a direction normal to the specific portion of the side wall. It should be understood that due to the specific dimension configuration according to this disclosure, the force or pressure leading to the displacement will take a specific direction defined by the precision pinching, such specific direction contributing to the displacement in a direction normal to the specific portion of the side wall. Such force or pressure may also comprise a minor component which may be parallel to the side wall, due to the fact that the hand is a human hand which does not necessarily align force completely perfectly, even when applying a precision pinch. The actuation is however triggered by a component of such force or pressure being normal to the portion of the side wall. Such presence of a component normal to the portion of the sidewall participates in the role of the lock of avoiding an accidental opening, whereas desired opening would take place by the consumer "pushing" the specific actuator and apply the unlocking force or pressure permitting opening of the lid.

In order to provide precision in locating a finger appropriately and obtain a precision pinch, the flanks comprise a specific actuation area in a specific flank, the actuation area facing the specific actuator. The fact that such actuation area faces the specific actuator indeed permits locating either the thumb or one or more of the other fingers on exactly the area on which a lock opening force should be applied. The actuation area should be understood as defining a localised discontinuity on the specific flank, whereby a user or consumer may perceive such discontinuity in order to correctly locate the thumb or one or more other fingers and apply the precision pinch. Such discontinuity may comprise one or more of an actuation aperture, an actuation flap, an actuation slit or an actuation membrane. In some examples, the actuation area, meaning either one or both of the specific or additional actuation area, the specific portion, or the additional portion, comprises a visual indication indicating the location of the actuation area. In some examples whereby the actuation area is an aperture, the specific portion, respectively additional portion, comprises a visual indication visible through the aperture, respectively apertures, when the lid is closed. The visual indication may be printed on an external surface of the flanks and may comprise one or more arrows or one or more areas printed in a striking colour or a specific text providing instructions such as "push here to open" for example, or a combination of any of these indications, in order to further increase precision of pinching. The actuation area is configured to permit displacing the specific actuator from the locking position to the opening position by applying the actuation pressure at the specific actuation area when the lid is in the closed position. In order to appropriately place the thumb or one or more other fingers, the specific actuation area spans less than 8 $cm^2$ and more than 0.2 $cm^2$. It was found that a larger area would lead to lack of precision in finger placement, and that a smaller area would lead to the actuation area being difficult to locate for a user or consumer. In some examples, the specific actuation area has a circular shape in order to ease positioning. Other shapes may be considered such as, for example, elliptical, oval, square, triangular, square with rounded corners, triangular with rounded corners, other polygonal shapes or other polygonal shapes with rounded corners.

As mentioned above, in order to reach an appropriate precision in precision pinch, the thumb should perceive a reaction force from the one or more fingers of the same hand, and the one or more fingers should perceive a reaction force from the thumb. This reciprocal feedback will lead to aligning the forces produced during the precision pinch leading to the opening of the lock. Such feedback should be transmitted by some structure which would directly or indirectly connect the specific actuation area with the flank opposite the specific flank. It was found that the role of such a structure transmitting the feedback forces could be fulfilled by the top of the lid when the specific actuation area was located in a specific manner, such specific manner permitting that the thumb and one or more other fingers enter in contact simultaneously with the specific flank and with the flank opposite the specific flank which are linked through the top of the lid. Such location of the specific area may be defined by the location of a specific centroid of the specific actuation area. The specific actuation area indeed defines a specific centroid, a centroid corresponding for example to a geometric centre of the actuation area or arithmetic mean position of all the points comprised in the specific actuation area. In order to achieve adequate reciprocal feedback transmission through the top of the lid, the specific centroid is separated from the top of the lid by less than 5 cm and by more than 0.5 cm and the specific centroid is separated from a distal end of the specific flank by more than 0.5 cm. The distal end should be understood as the end of the flank away from the top of the lid along the direction of the box sidewalls. In order to permit pinching across the top of the lid, the top of the lid spans less than 13 cm and more than 6 cm along a direction normal to the specific portion at the specific centroid. It was found that a larger span would prevent pinching, and that a smaller span would not permit providing a sufficient opening size to access the detergent contained in the box. Without wishing to be bound by theory, it is believed that a shorter span may not provide a precision pinch offering an appropriate balance of power and precision for the purpose of opening the lock according to this disclosure. In some examples, the top of the lid spans less than 12 cm and more than 7 cm along a direction normal to the specific portion at the specific centroid. In some examples, the top of the lid spans less than 11 cm and more than 8 cm along a direction normal to the specific portion at the specific centroid. In some examples, the top of the lid spans less than 10 cm and more than 9 cm along a direction normal to the specific portion at the specific centroid.

FIG. 1 illustrates an example consumer product 100 comprising a detergent product (not visible) and a container, the container comprising a box 101 comprising the detergent product, a lid 102 for the box 101, and a lock 103 to maintain the lid 101 in a closed position. The box comprising a base 110, sidewalls 111-114 and an opening opposite the base, the lid 102 comprising a top 120 and flanks 121-124, the top 120 covering the opening and the flanks 121-124 covering at least a specific portion of a specific sidewall of the sidewalls 111-114 of the box 101 when the lid 102 is in the closed position, the lock 103 comprises a specific actuator 130 moveable from a locking position to an opening position by applying an actuation pressure onto the specific actuator 130 when the lid is 102 in the closed position, the specific actuator 130 being connected to the specific portion, the flanks 121-124 comprising a specific actuation area 104 in a specific flank 121, the actuation area 104 facing the specific actuator 130 and permitting displacing the specific actuator 130 from the locking position to the opening position by applying the actuation pressure at the specific actuation area 104 when the lid 102 is in the closed position.

In example consumer product 100 the box has a rectangular base and the lid has a rectangular top. The sidewalls and flanks are also rectangular. In this example, the lid is illustrated in the open position in order to visualize the various elements. In this example, the actuation area 104 is a round aperture having a 2.4 cm diameter which defines a specific actuation area of about 4.5 $cm^2$. Actuation area 104 defines a specific centroid which corresponds to the center of the round aperture. In this example, the center of the aperture is separated from the top of the lid by about 20 mm as illustrated by distance 150 which is the shortest distance between the specific centroid and a point comprised in the top of the lid, the distance in this case being along a direction perpendicular to the top of the lid and along flank 121 into which the aperture 104 is cut out. The specific centroid, or center of round actuation area 104, is in this example separated from a distal end of the specific flank by 50 mm as illustrated by distance 151 which is the shortest distance between the specific centroid and a point comprised in the distal end of flank 121 of the lid, the distance in this case being along a direction perpendicular to the top of the lid and along flank 121 into which the aperture 104 is cut out. In this example, the top of the lid spans 94 mm along a direction normal to the specific portion at the specific centroid, as illustrated by distance 152 which in this case is parallel to the top of the lid and normal to the specific flank 121 where the specific actuation area is located. In this example, the lock 103 comprises a flap 130 which may be pushed through the aperture 104 when the lid is in the closed position. Lid 102 may be removed by, with a first adult hand, placing either the thumb or any other finger on the actuation area 104, and the opposite finger or fingers of the same adult hand on the flank 123 opposite the specific flank, the first adult hand thereby pinching the lid 102 across its top 120 and pushing onto flap 130 while holding the box 101 with the other adult hand to lifting the lid open as the flap 130 remains pressed against the specific portion of sidewall 111.

Figure 2:
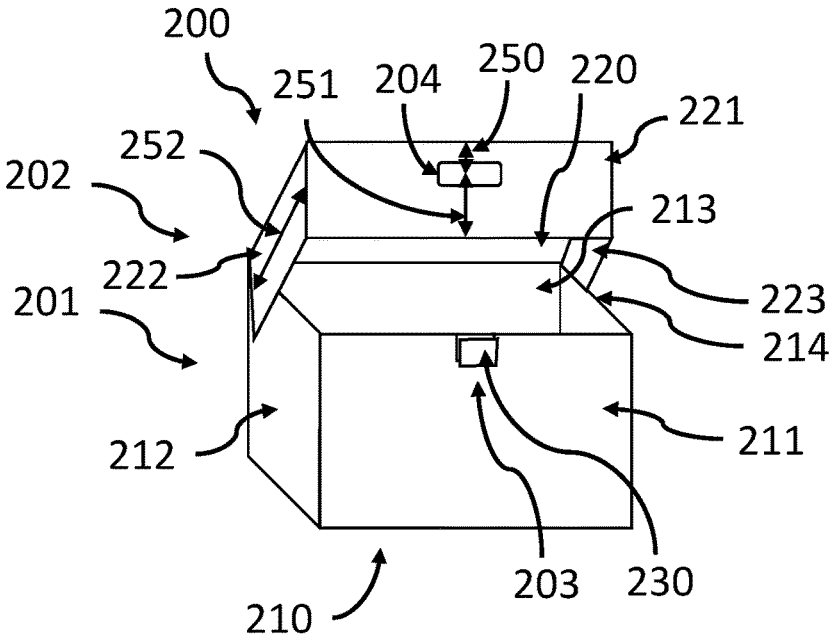
FIG. 2 illustrates a second example consumer product.

FIG. 2 illustrates an example consumer product 200 comprising a detergent product (not visible) and a container, the container comprising a box 201 comprising the detergent product, a lid 202 for the box 201, and a lock 203 to maintain the lid 201 in a closed position. The box comprising a base 210, sidewalls 211-214 and an opening opposite the base, the lid 202 comprising a top 220 and flanks 221-223, the top 220 covering the opening and the flanks 221-223 covering at least a specific portion of a specific sidewall of the sidewalls 211-214 of the box 201 when the lid 202 is in the closed position, the lock 203 comprises a specific actuator 230 moveable from a locking position to an opening position by applying an actuation pressure onto the specific actuator 230 when the lid is 202 in the closed position, the specific actuator 230 being connected to the specific portion, the flanks 221-223 comprising a specific actuation area 204 in a specific flank 221, the actuation area 204 facing the specific actuator 230 and permitting displacing the specific actuator 230 from the locking position to the opening position by applying the actuation pressure at the specific actuation area 204 when the lid 202 is in the closed position.

In example consumer product 200 the box has a rectangular base and the lid has a rectangular top. In this example, the lid is a hinged lid connected by a fold line to sidewall 213 opposite side wall 211 comprising the specific portion. The sidewalls and flanks are also rectangular. In this example, the lid is illustrated in the open position in order to visualize the various elements. In this example, the actuation area 204 is a rectangular membrane having rounded edged and covering an underlying aperture, the rectangular membrane having a 1 cm height along a direction normal to the top of the lid and a length of 3 cm in a direction perpendicular to the height direction, thereby defining a specific actuation area of about 3 $cm^2$. Actuation area 204 defines a specific centroid which corresponds to the center of the rectangle membrane. In this example, the specific centroid is separated from the top of the lid by 30 mm as illustrated by distance 250 which is the shortest distance between the specific centroid and a point comprised in the top of the lid, the distance in this case being along a direction perpendicular to the top of the lid and along flank 221 where the actuation area is located. The specific centroid is in this example separated from a distal end of the specific flank 221 by 30 mm as illustrated by distance 251 which is the shortest distance between the specific centroid and a point comprised in the distal end of flank 221 of the lid, the distance in this case being along a direction perpendicular to the top of the lid and along flank 221 into which the actuation area 204 is cut out. In this example, the top of the lid spans 100 mm along a direction normal to the specific portion at the specific centroid, as illustrated by distance 252 which in this case is parallel to the top of the lid and normal to the specific flank 221 where the specific actuation area is located. In this example, the lock 203 comprises a spring loaded push button 230 which may be actuated through the membrane of actuation area 204 when the lid is closed. Lid 202 may be opened by, with a first adult hand, placing either the thumb or any other finger on the actuation area 204, and the opposite finger or fingers of the same adult hand on the sidewall 223 opposite the sidewall 211 comprising the actuation area, the first adult hand thereby pinching the lid 202 across its top 220 and pushing onto button 230 while holding the box 201 with the other adult hand, to hinge the lid open as the button 230 remains pressed against the specific portion of sidewall 211.

Figure 3:
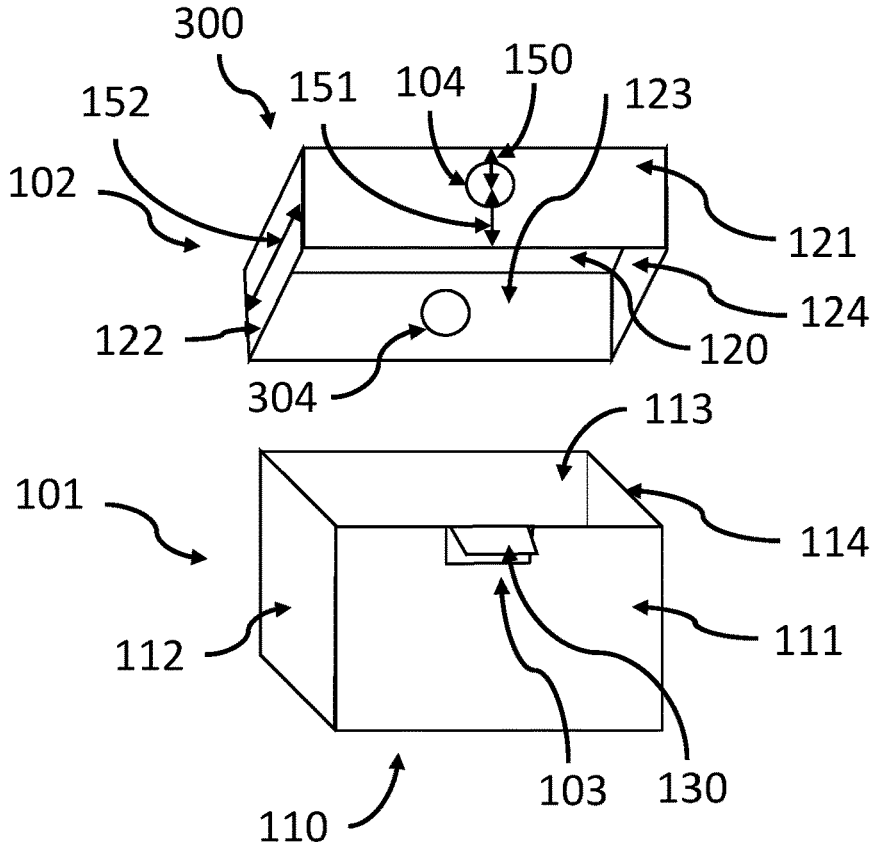
FIG. 3 illustrates a third example consumer product.

FIG. 3 illustrates an example consumer product 300 comprising the elements described in the context of FIG. 1, the same reference numerals being used, in addition to an additional actuation area 304 in opposite flank 123, whereby, in this example, the actuation area 304 is of the same nature as actuation area 104, the opposite flank 123 being opposite the specific flank 121, the additional actuation 304 area being adjacent to an additional portion of a sidewall 113 opposite the specific sidewall 111, whereby:

- the additional actuation area spans less than 8 cm2 and more than 0.2 cm2, in this specific example about 0.8 $cm^2$, the additional actuation 304 area defining an additional centroid; the additional centroid is separated from the top of the lid by less than 5 cm and by more than 0.5 cm, preferably between 1.5 cm and 2.5 cm, and in this specific example by about 2 cm;
- the additional centroid is separated from a distal end of the opposite flank by more than 0.5 cm;
- the additional centroid is aligned with the specific centroid along a direction normal to the additional portion at the additional centroid; and the additional centroid and the specific centroid are separated by more than 6 cm and by less than 13 cm, this separation distance being understood as a mean shortest direct distance.

In a preferred example, the additional centroid is separated from a distal end of the opposite flank by a distance of about 5 cm.

In a preferred example, the additional centroid and the specific centroid are separated by about 94 mm.

In some example, the specific centroid is separated from a distal end of the specific flank by a distance D1 and the additional centroid is separated from a distal end of the opposite flank by a distance D2, whereby D1 differs from D2 by more than 5% of the value of D1. In an example, D1 is of about 1.5 cm and D2 is of about 3 cm. Such difference in distances from respective distal end can permit adjusting the measurements of the precision pinch desired. In some examples, D1 and D2 differ by less than 1 cm, preferably by less than 0.5 cm. Such offset between D1 and D2 can contribute to reducing instances of accidental opening upon lifting the box by the 2 actuation areas simultaneously, while limiting such offset enables a precision pinch.

In some examples, the additional actuation area has a circular shape in order to ease positioning. Other shapes may be considered such as, for example, elliptical, oval or polygonal shapes.

A configuration as per example of FIG. 3 permits precise placement on opposite sides across the top of the lid, thereby further easing the application of a precision pinch.

One should note that while a configuration comprising an additional actuation area is illustrated by the example of FIG. 3, other configuration may be considered, which may for example combine an additional actuation area which may be of a different type or have different dimensions from the specific actuation area, and may not necessarily be placed exactly opposite the specific actuation area. In addition to improving precision pinch by increasing finger placement precision, using an additional actuation area may for example enable use of a same box by right handed or left handed people regardless of the box location.

In some examples such as illustrated in FIG. 3, a shortest distance between the additional centroid and the specific centroid along the specific flank, top of the lid and opposite flank is of less than 18 cm, thereby permitting exerting a precision pinch between both actuation areas across the top of the lid with an adult hand. In some examples, the shortest distance between the additional centroid and the specific centroid along the specific flank, top of the lid and opposite flank is of less than 15 cm. In an example, In some examples, the shortest distance between the additional centroid and the specific centroid along the specific flank, top of the lid and opposite flank is of 13.4 cm decomposed in 9.5 cm across the top of the lid, 2 cm along the specific flank, and 2 cm along the opposite flank.

Figure 4:
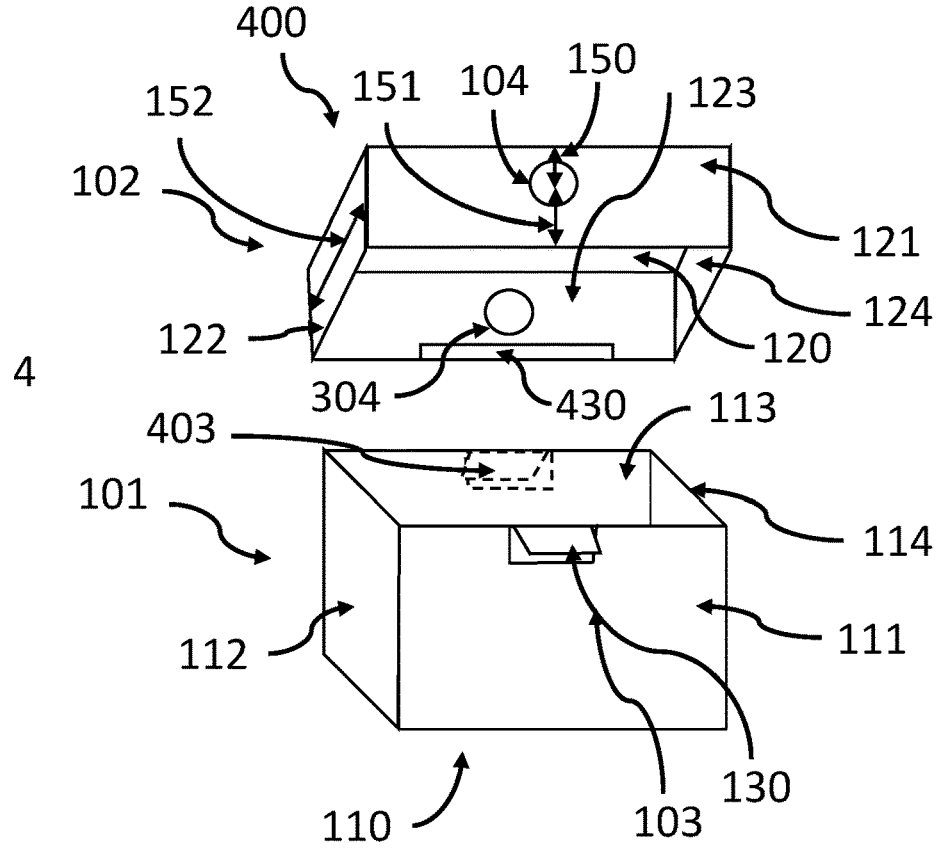
FIG. 4 illustrates a fourth example consumer product.

FIG. 4 illustrates an example consumer product 400. This example consumer product 400 comprises the elements of consumer product 300 which are numbered using the same reference numerals. In addition to these, example consumer product 400 comprises an additional actuator 403, the additional actuator 403 being connected to the additional portion of the sidewall 113 opposite the specific sidewall 111, the additional actuator 403 facing the additional actuation area 304 when the lid 102 is closed. The additional actuator 403 is represented with a flap similar to flap 130 which interacts with a tab 430 placed on the inside of flap 123 to reinforce the locking of the lid. Pinching will in this case unlock both the additional actuator and the specific actuator to permit opening the lid. While the tab is illustrated as spanning a portion of the corresponding flap 123, tabs may span an entire length of the corresponding flap. A tab (not visible) is provided on the inside of flap 121 to interact with flap 130 and contribute to the locking. One should note that while the additional actuator 403 is represented as symmetrically opposed to the specific actuator 130 and as having the same nature and dimensions, such actuators may take in other examples different natures and dimensions, and may not necessarily be symmetrical.

Figure 5:
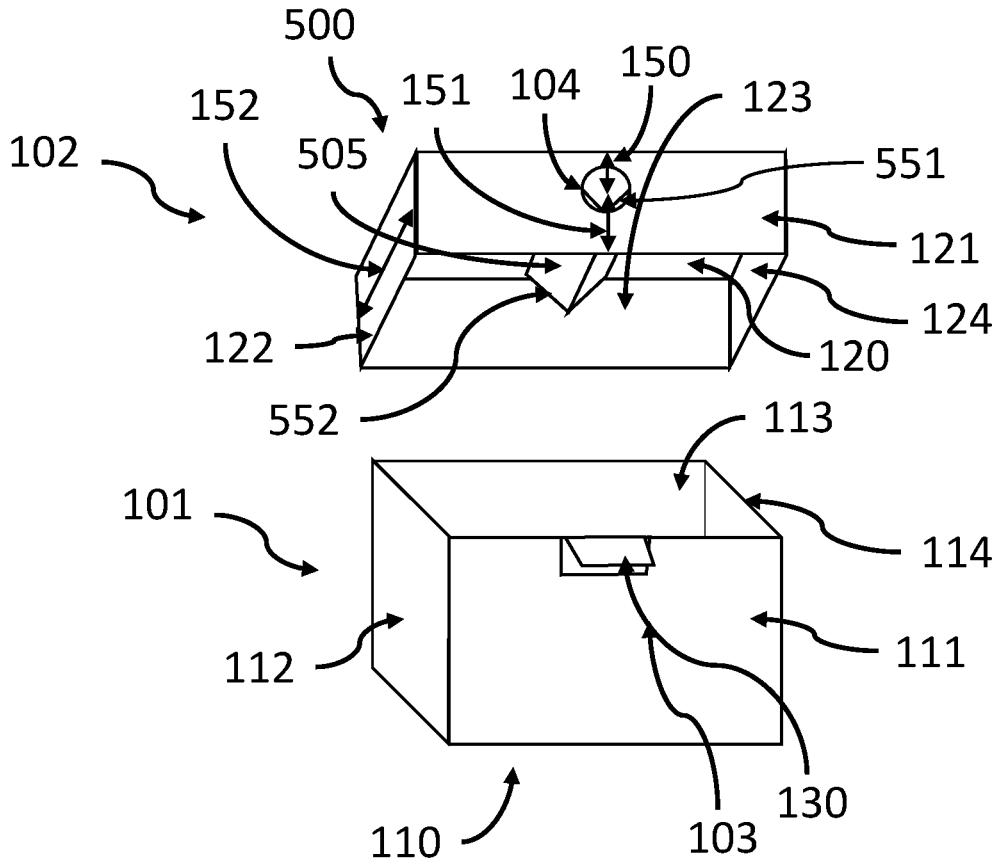
FIG. 5 illustrates a fifth example consumer product.

FIG. 5 illustrates an example consumer product 500. This example consumer product 500 comprises the elements of consumer product 100 which are numbered using the same reference numerals. In addition to these, example consumer product 500 comprises a transversal support element 505 of the lid 102 extended from a first end 551 of the support element to a second end 552 of the support element along the direction normal to the specific portion at the specific centroid, the support element 505 being attached or integrated to the top of the lid, whereby the specific portion is, when the lid is closed, located between the first 551 end and the specific actuation area 104, the first end 551 being separated from the specific actuation area 104 by a clearance of less than 1 cm and of more than 0.5 mm along the direction normal to the specific portion at the specific centroid. This support element permits improving the transmission of a feedback force when pinching the lid. The support element also permits reinforcing the lid structure and the lock structure whereby a part of the sidewalls 111 and 113 slide between the flanks and the support element when the lid is closed. The specific clearance dimension permit pinching the support element when pinching the lid, thereby enabling a direct force feedback in addition to the feedback taking place through the top of the lid itself. One should note that while the support is represented as having a triangular profile or triangular cross section, other profiles or cross sections may be provided while fulfilling the function of the support element.

Figure 6:
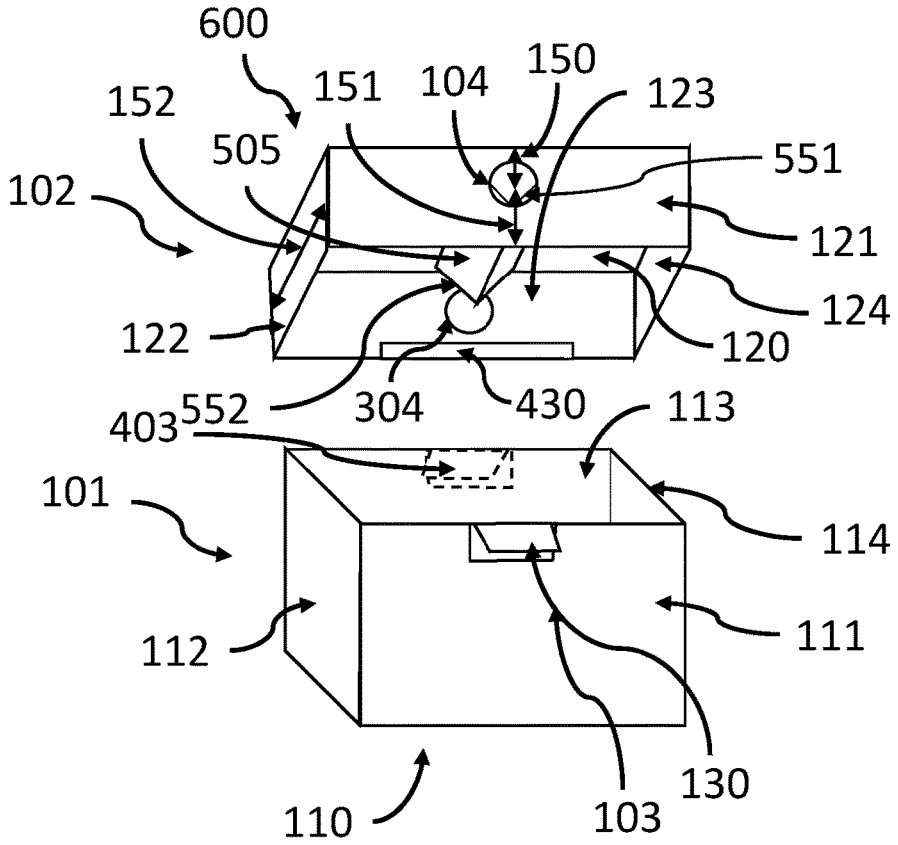
FIG. 6 illustrates a sixth example consumer product.

FIG. 6 illustrates an example consumer product 600. This example consumer product 600 comprises a combination of elements of consumer product 500 and of consumer product 400, whereby this consumer product 600 is such that the additional portion is located between the second end 552 and the additional actuation area 304 when the lid is closed, the second end 552 being separated from the additional actuation 304 area by a clearance of less than 1 cm and of more than 0.5 mm along a direction normal to the additional portion at the additional centroid. Using this configuration, precision pinch is further reinforced by the precise location of fingers on both sides of the lid and by direct force feedback between both sides of the lid through the support element, while providing a double lock. It should be understood that alternative combinations could comprise different box shapes, support element shapes, actuation area shapes or lock shapes.

It should be noted that as illustrated in FIG. 5 or 6, the combination of a lock and of a support element, in addition to increasing the precision of pinching, would participate in suppressing or reducing the risk of accidental opening of the lid while permitting desired opening by a consumer. The avoidance or reduction of the risk of accidental opening would for example apply to a force being applied in a direction parallel to the sidewalls for example by friction with another box located side to side with a box according to this disclosure, or by a box falling over during transportation, or by internal movements of the content of the box pushing the lid during transportation. Strong pulling in a direction parallel to the sidewall may indeed impact the structure of the sidewall, for example resulting in bending of the side wall, whereby such bending may produce undesired disengagement of a locking tab from an activator, due to the fact that the specific actuator is connected to the specific portion of the sidewall. This could lead to an undesired opening of the lid. Such undesired opening of the lid may be more likely if the sidewall is made of a material such as cardboard used to form the sidewalls, in particular when the box is a cardboard box.

In some examples, the lock is placed in a central area of a sidewall of the box. A central area should be understood as substantially equidistant from opposite edges of the sidewall concerned, such edges being along a direction normal to the base of the box. In such examples, it should be understood that the lock is located closest to an edge of the sidewall close to the opening than to an edge of the sidewall close to the base, while being in a central area in respect to the edges normal to the base. Such central location of the lock may participate in avoiding sliding of the lid from the box if the box is lifted by holding the lid by applying pressure onto the specific actuator, whereby such pressure presses the specific actuator against the support element structure centrally, thereby balancing the forces maintaining the connection between the lid and the box and participating in avoiding accidental opening. In some examples, the lock may be located on a sidewall and between two edges of the sidewall, such edges being normal to the base, the lock being closer to one edge than to the other edge of the two edges, for example located closer to the one edge at a ⅓ of the distance between the two edges. In some examples one sidewall may comprise two locks. In some examples two locks may be provided offset versus each versus a centreline to increase a distance separating the two locks. In some examples more than two locks may be provided. In some examples, three locks are provided, for example corresponding to a first lock for a thumb of a user hand and two other locks on the other side of the lid for an index and middle finger of the same user hand so such user may actuate the three locks one handed and simultaneously while holding the box with the other hand.

In some examples, the specific centroid, and respectively additional centroid when present, is located in a central region of a flank of the lid along a horizontal direction parallel to the top of the lid. A central area should be understood as substantially equidistant from opposite edges of the flank concerned, such edges being along a direction normal to the top of the lid. Such a configuration permits using a reversible lid, in particular when both a specific centroid and additional centroid are present.

The present disclosure also aims at resolving an apparent contradiction between, on one hand, the use of materials for the sidewalls which would resist accidental opening, and the use of materials for the sidewalls which are particularly environmentally friendly.

The container may indeed be made from paper or cardboard material, in particular rigid cardboard material, flexible cardboard material or a mixture thereof. In some example, the material forming the box or the lid has a wall thickness of more than 220 microns and of less than 3 mm. In some example, the material forming the box or the lid has a wall thickness of more than 1 mm and of less than 2 mm. In some example, the material forming the box or the lid is folded on itself, for example to reinforce parts of or the whole of the box or the lid. The container may be made from paper materials, bio based material, bamboo fibres, cellulose fibres, cellulose based or fibre based materials, or a mixture thereof. The container may be made from materials comprising recycled materials, for example recycled cellulose fiber based materials. In some examples, in order to facilitate opening, the lid may be entirely separated from the box when open, and the lid weighs less than 200 g, preferably less than 100 g, even more preferably less than 80 g, and more than 10 g, more preferably more than 30 g, even more preferably more than 40 g, in order to obtain a sufficiently robust lid structure.

The lid according to some examples comprises a support element structure permitting rendering the pinching more precise, the support element structure entering the opening of the box when the lid is in the closed position, at least part of the specific portion of the sidewalls being located between the flanks and the support element structure when the lid is in the closed position, a clearance distance separating the sidewalls from the support element structure in a direction normal to the specific portion of the sidewalls when the lid is in the closed position and when no actuation pressure is applied, the clearance distance being reduced to zero by flexing of the specific portion of the sidewalls when the actuation pressure is applied above a pressure threshold when the lid is in the closed position. Both the support element structure and the flanks are structurally part of the lid, the support element structure and the flanks permitting sandwiching the specific portion of the sidewall, thereby preventing sinking in of the specific portion of the sidewall and undesired disengagement of the specific actuator from the locking tab. It is important to take note of the fact that in case of an actuation pressure being applied while lifting the box through the lid, the pressure applied will catch the sandwiched specific portion of the sidewall against the support element structure, thereby compensating a force of gravity which would otherwise disconnect the lid from the box, such compensation of the gravity force being through a resisting static friction force between the specific portion of the sidewall and the support element structure. In some examples, the use of the support element structure permits using for making the box a relatively flexible material, whereby such flexible material would flex in the absence of the support element structure to the point that the box would fall off if lifted by its lid. Permitting using a relatively flexible material also permits using a lesser quantity of such material due to the presence of the support element structure which compensates for such flexibility. The presence of such support element structure thereby prevents or reduces the risk of accidental opening even if the actuation pressure is applied onto the specific actuator of the lock, for example as the box is lifted while applying pressure on the specific actuator of the lock.

The support element structure enters the opening when the lid is in the closed position, fitting within the box when the lid is in the closed position. Such entering the opening should be understood in that the support element structure comprises a support element structure portion which enters the opening when the lid is moved from the open to the closed position, and whereby such support element structure portion exits the opening when the lid is moved from the closed to the open position. At least part of the specific portion of the sidewalls is located between the flanks and the support element structure when the lid is in the closed position. This structure permits capturing the specific portion of the sidewall between the flanks and the support element structure, the specific portion of the sidewall getting inserted between the flanks and the support element structure when the lid moves from the open to the closed position, the specific portion of the side wall being released from between the flanks and the support element structure when the lid moves from the closed to the open position. A clearance distance separates the sidewalls from the support element structure in a direction normal to the specific portion of the sidewalls when the lid is in the closed position, such direction corresponding for example to a direction of a linear ridge of the support element, and when no actuation pressure is applied. Such clearance distance would exist on a first side, and be repeated additionally on a second side of the support element structure. Such clearance distance permits insertion of the support element structure through the opening as the lid gets closed, such that the support element structure does not collide with the specific portion of the sidewall when the lid gets closed. The clearance is reduced to zero by flexing of the specific portion of the sidewalls when the actuation pressure is applied above a pressure threshold when the lid is in the closed position. When such pressure threshold is reached, the sidewall lays against the support element structure through the clearance distance being reduced to zero, the sidewall thereby being prevented from being exceedingly distorted and being prevented from sinking in to the point of the specific actuator releasing the locking tab, and permitting feedback force being transmitted from one side of the pinch to the other side of the pinch. The clearance distance according to such examples relates in some examples to a tolerance distance between the lid and the box which both permits placing the lid onto the box without undue difficulty, while avoiding that the lid be loose when in the closed position. While the clearance distance according to this disclosure is considered in a region of the lock, the tolerance distance between the lid and the box may be considered along an entire perimeter of the opening of the box. In some examples, the tolerance is of at least 0.1 mm and of less than 5 mm. In some examples the tolerance is of at least 0.5 mm and of less than 3 mm Such tolerance would for example be measured when the lid is in the closed position and between an internal surface of the flanks and an external surface of the sidewalls, understanding that such tolerance may take a different value in a region of the lock.

In some examples, the clearance distance is of at least 1 mm and of less than 1 cm when the lid is in the closed position and no actuation pressure is applied. Such a range permits both easing the closing of the lid and preventing sinking of the specific portion of the sidewall leading to undesired unlocking. In some examples, the clearance distance is of at least 1.5 mm and of less than 0.5 cm when the lid is in the closed position and no actuation pressure is applied. In some examples, the clearance distance is of at least 2 mm and of less than 0.4 cm when the lid is in the closed position and no actuation pressure is applied.

In some examples, the lid comprises a corrugated cardboard layer, the corrugated cardboard layer comprising flutes, the flutes preferably running parallel to the direction normal to the specific portion at the specific centroid and parallel to the top of the lid, and whereby the specific actuation area, and respectively additional actuation area, preferably intersect at least some of the flutes. Such a structure permits reinforcing the top of the lid in the direction of pinching, thereby further increasing the pinching force feedback and thereby pinch precision. The intersecting of flutes by an actuation area in the form of an aperture also permits ventilating the flank or flanks in which the aperture is provided, thereby reinforcing flank integrity in humid environments.

In some examples the detergent product comprises a detergent composition. The detergent composition may be a laundry detergent composition, an automatic dishwashing composition, a hard surface cleaning composition, or a combination thereof. The detergent composition may comprise a solid, a liquid or a mixture thereof. The term liquid includes a gel, a solution, a dispersion, a paste, or a mixture thereof. The solid may be a powder. By powder we herein mean that the detergent composition may comprise solid particulates or may be a single homogenous solid. In some examples, the powder detergent composition comprises particles. This means that the powder detergent composition comprises individual solid particles as opposed to the solid being a single homogenous solid. The particles may be free-flowing or may be compacted. A laundry detergent composition can be used in a fabric hand wash operation or may be used in an automatic machine fabric wash operation, for example in an automatic machine fabric wash operation. Example laundry detergent compositions comprise a non-soap surfactant, wherein the non-soap surfactant comprises an anionic non-soap surfactant and a non-ionic surfactant. In some examples, the laundry detergent composition comprises between 10% and 60%, or between 20% and 55% by weight of the laundry detergent composition of the non-soap surfactant.

Example weight ratio of non-soap anionic surfactant to nonionic surfactant are from 1:1 to 20:1, from 1.5:1 to 17.5:1, from 2:1 to 15:1, or from 2.5:1 to 13:1. Example non-soap anionic surfactants comprises linear alkylbenzene sulphonate, alkyl sulphate or a mixture thereof. Example weight ratio of linear alkylbenzene sulphonate to alkyl sulphate are from 1:2 to 9:1, from 1:1 to 7:1, from 1:1 to 5:1, or from 1:1 to 4:1. Example linear alkylbenzene sulphonates are $C_{10}$-$C_{16}$ alkyl benzene sulfonic acids, or $C_{11}$-$C_{14}$ alkyl benzene sulfonic acids. By 'linear', we herein mean the alkyl group is linear. Example alkyl sulphate anionic surfactant may comprise alkoxylated alkyl sulphate or non-alkoxylated alkyl sulphate or a mixture thereof. Example alkoxylated alkyl sulphate anionic surfactant comprise an ethoxylated alkyl sulphate anionic surfactant. Example alkyl sulphate anionic surfactant may comprise an ethoxylated alkyl sulphate anionic surfactant with a mol average degree of ethoxylation from 1 to 5, from 1 to 3, or from 2 to 3. Example alkyl sulphate anionic surfactant may comprise a non-ethoxylated alkyl sulphate and an ethoxylated alkyl sulphate wherein the mol average degree of ethoxylation of the alkyl sulphate anionic surfactant is from 1 to 5, from 1 to 3, or from 2 to 3. Example alkyl fraction of the alkyl sulphate anionic surfactant are derived from fatty alcohols, oxo-synthesized alcohols, Guerbet alcohols, or mixtures thereof. In some examples, the laundry detergent composition comprises between 10% and 50%, between 15% and 45%, between 20% and 40%, or between 30% and 40% by weight of the laundry detergent composition of the non-soap anionic surfactant. In some examples, the non-ionic surfactant is selected from alcohol alkoxylate, an oxo-synthesised alcohol alkoxylate, Guerbet alcohol alkoxylates, alkyl phenol alcohol alkoxylates, or a mixture thereof. In some examples, the laundry detergent composition comprises between 0.01% and 10%, between 0.01% and 8%, between 0.1% and 6%, or between 0.15% and 5% by weight of the liquid laundry detergent composition of a non-ionic surfactant. In some examples, the laundry detergent composition comprises between 1.5% and 20%, between 2% and 15%, between 3% and 10%, or between 4% and 8% by weight of the laundry detergent composition of soap, in some examples a fatty acid salt, in some examples an amine neutralized fatty acid salt, wherein in some examples the amine is an alkanolamine for example selected from monoethanolamine, diethanolamine, triethanolamine or a mixture thereof, in some examples monoethanolamine. In some examples, the laundry detergent composition is a liquid laundry detergent composition. In some examples the liquid laundry detergent composition comprises less than 15%, or less than 12% by weight of the liquid laundry detergent composition of water. In some examples, the laundry detergent composition is a liquid laundry detergent composition comprising a non-aqueous solvent selected from 1,2-propanediol, dipropylene glycol, tripropyleneglycol, glycerol, sorbitol, polyethylene glycol or a mixture thereof. In some examples, the liquid laundry detergent composition comprises between 10% and 40%, or between 15% and 30% by weight of the liquid laundry detergent composition of the non-aqueous solvent. In some examples, the laundry detergent composition comprises a perfume. In some examples, the laundry detergent composition comprises an adjunct ingredient selected from the group comprising builders including enzymes, citrate, bleach, bleach catalyst, dye, hueing dye, brightener, cleaning polymers including alkoxylated polyamines and polyethyleneimines, soil release polymer, surfactant, solvent, dye transfer inhibitors, chelant, encapsulated perfume, polycarboxylates, structurant, pH trimming agents, and mixtures thereof. In some examples, the laundry detergent composition has a pH between 6 and 10, between 6.5 and 8.9, or between 7 and 8, wherein the pH of the laundry detergent composition is measured as a 10% product concentration in demineralized water at 20° C. When liquid, the laundry detergent composition may be Newtonian or non-Newtonian. In some examples, the liquid laundry detergent composition is non-Newtonian. Without wishing to be bound by theory, a non-Newtonian liquid has properties that differ from those of a Newtonian liquid, more specifically, the viscosity of non-Newtonian liquids is dependent on shear rate, while a Newtonian liquid has a constant viscosity independent of the applied shear rate. The decreased viscosity upon shear application for non-Newtonian liquids is thought to further facilitate liquid detergent dissolution. The liquid laundry detergent composition described herein can have any suitable viscosity depending on factors such as formulated ingredients and purpose of the composition.

In some examples, the consumer product comprises at least one water-soluble unit dose article and the container. The consumer product can be sold 'as is', in other words the consumer product is the item that the consumer picks up from the shelf. Alternatively, the consumer product could be housed as one unit of a multi-component product. For example, more than one consumer product could be housed within an outer package and the multiple packaged consumer products sold together in a single purchase. The consumer product may comprise aesthetic elements, for example shrink sleeves or labels attached to the container. Alternatively, the container may be coloured or printed with aesthetic elements or informative print such as usage instructions.

In some examples a water-soluble unit dose article comprises at least one water-soluble film orientated to create at least one-unit dose internal compartment, wherein the at least one-unit dose internal compartment comprises a detergent composition. The water-soluble film and the detergent composition are described in more detail below. In some examples the consumer product comprises at least one water-soluble unit dose article, in some cases at least two water-soluble unit dose articles, in some cases at least 10 water-soluble unit dose articles, in some cases at least 20 water-soluble unit dose articles, in some cases at least 30 water-soluble unit dose articles, in some cases at least 40 water-soluble unit dose articles, in some cases at least 45 water-soluble unit dose articles. A water-soluble unit dose article is in some examples in the form of a pouch. A water-soluble unit dose article comprises in some examples a unitary dose of a composition as a volume sufficient to provide a benefit in an end application. The water-soluble unit dose article comprises in some examples one water-soluble film shaped such that the unit-dose article comprises at least one internal compartment surrounded by the water-soluble film. The at least one compartment comprises a cleaning composition. The water-soluble film is sealed such that the cleaning composition does not leak out of the compartment during storage. However, upon addition of the water-soluble unit dose article to water, the water-soluble film dissolves and releases the contents of the internal compartment into the wash liquor. The unit dose article may comprise more than one compartment, at least two compartments, or at least three compartments, or at least four compartments, or even at least five compartments. The compartments may be arranged in superposed orientation, i.e. one positioned on top of the other. Alternatively, the compartments may be positioned in a side-by-side orientation, i.e. one orientated next to the other. The compartments may be orientated in a 'tyre and rim' arrangement, i.e. a first compartment is positioned next to a second compartment, but the first compartment at least partially surrounds the second compartment, but does not completely enclose the second compartment. Alternatively, one compartment may be completely enclosed within another compartment. In some examples the unit dose article comprises at least two compartments, one of the compartments being smaller than the other compartment. In some examples the unit dose article comprises at least three compartments, two of the compartments may be smaller than the third compartment, and in some examples the two smaller compartments being superposed on the larger compartment. In some examples the unit dose article comprises at least four compartments, three of the compartments may be smaller than the fourth compartment, and in some examples the three smaller compartments being superposed on the larger compartment. The superposed compartments are in some examples orientated side-by-side. In some examples each individual unit dose article may have a weight of between 10 g and 40 g, or even between 15 g and 35 g. The water soluble film may be soluble or dispersible in water. Prior to be being formed into a unit dose article, the water-soluble film has in some examples a thickness of from 20 to 150 micron, in other examples 35 to 125 micron, in further examples 50 to 110 micron, in yet further examples about 76 micron. Example water soluble film materials comprise polymeric materials. The film material can, for example, be obtained by casting, blow-moulding, extrusion or blown extrusion of the polymeric material. In some examples, the water-soluble film comprises polyvinyl alcohol polymer or copolymer, for example a blend of polyvinylalcohol polymers and/or polyvinylalcohol copolymers, for example selected from sulphonated and carboxylated anionic polyvinylalcohol copolymers especially carboxylated anionic polyvinylalcohol copolymers, for example a blend of a polyvinylalcohol homopolymer and a carboxylated anionic polyvinylalcohol copolymer. In some examples water soluble films are those supplied by Monosol under the trade references M8630, M8900, M8779, M8310. In some examples the film may be opaque, transparent or translucent. The film may comprise a printed area. The area of print may be achieved using techniques such as flexographic printing or inkjet printing. The film may comprise an aversive agent, for example a bittering agent. Suitable bittering agents include, but are not limited to, naringin, sucrose octaacetate, quinine hydrochloride, denatonium benzoate, or mixtures thereof. Example levels of aversive agent include, but are not limited to, 1 to 5000 ppm, 100 to 2500 ppm, or 250 to 2000 ppm. The water-soluble film or water-soluble unit dose article or both may be coated with a lubricating agent. In some examples, the lubricating agent is selected from talc, zinc oxide, silicas, siloxanes, zeolites, silicic acid, alumina, sodium sulphate, potassium sulphate, calcium carbonate, magnesium carbonate, sodium citrate, sodium tripolyphosphate, potassium citrate, potassium tripolyphosphate, calcium stearate, zinc stearate, magnesium stearate, starch, modified starches, clay, kaolin, gypsum, cyclodextrins or mixtures thereof.

In some examples the container comprises a first part, wherein the first part comprises a first compartment in which the at least one water-soluble unit dose article is contained. In some examples the first compartment comprises at least two water-soluble unit dose articles. The first compartment may comprise between 1 and 80 water-soluble unit dose articles, between 1 and 60 water-soluble unit dose articles, between 1 and 40 water-soluble unit dose articles, or between 1 and 20 water-soluble unit dose articles. The volume of the first compartment may be between 500 ml and 5000 ml, in some examples between 800 ml and 4000 ml.

In some examples, the detergent product is in the form of unit dose detergent pouches, preferably in the form of flexible water soluble unit dose detergent pouches, whereby the aperture is configured to prevent a unit dose detergent pouch from passing through the aperture. It should be understood that with containers as illustrated in any of FIG. 1 or 3 to 6, it is indeed possible that the container be for some reason stored upside down, in which case an accidental opening would result in filling the lid with detergent pouches. In such a situation, having the aperture configured to prevent a unit dose detergent pouch from passing through the aperture permits avoiding spilling detergent pouches accidentally through the aperture. In some examples, the pouches have a minimum cross section, such minimum cross section being in some cases surrounded by an external flange area, such minimum cross section intersecting an internal volume of the detergent article comprising the detergent, such minimum cross section being of less than the actuation area aperture. For example, if the actuation area aperture is of 1 $cm^2$, pouches having a minimum cross section of 1.5 $cm^2$ will not spill through the aperture.

In some examples, one or more flank of the flanks comprising a respective actuation area covers at least 30% of one or more respective sidewall of the sidewalls when the lid is in the closed position. In such examples, if the respective actuation area is an aperture, such aperture will to some degree permit evacuating air comprised in the lid while closing the lid as the lid slides onto the box. In some examples, the lid defines a lid internal volume delimited by the top of the lid and the flanks. In some examples the lid internal volume is comprised between 200 and 2000 $cm^3$, preferably between 750 $cm^3$ and 1500 $cm^3$. In some examples, one or more flank of the flanks comprising a respective actuation area covers at least 40% of one or more respective sidewall of the sidewalls when the lid is in the closed position. In some examples, one or more flank of the flanks comprising a respective actuation area covers at least 50% of one or more respective sidewall of the sidewalls when the lid is in the closed position. Providing a higher flank coverage increases robustness and permits holding the content of the container in the lid case of an accidental upside down opening. Such configurations may be advantageously combined in some examples with an aperture configured to prevent a unit dose detergent pouch from passing through the aperture.

In some examples, the specific centroid, and respectively additional centroid, is separated from the top of the lid by more than 1 cm and by less than 3 cm. Such dimensioning was found particularly effective at applying a high precision pinch.

In some examples, the specific actuation area, and respectively additional actuation area, covers less than 6 $cm^2$ and more than 1 $cm^2$. Such dimensioning was also found particularly effective at applying a high precision pinch.

In some examples, the flanks comprising two short flanks and two long flanks, whereby the specific actuation area, and the respectively additional actuation area if present, is on a long flank. This configuration permits increasing rigidity of the top of the lid in the direction of the pinch, while maintaining a desired container inner volume. The lid may indeed comprise two opposite long flanks parallel to each other and two opposite short flanks parallel to each other, the long flanks being perpendicular to the short flanks, the long flanks being preferably reinforced, in order to take into account the fact that a user or consumer may be more likely to apply pressure on long flanks, and that long flanks are more likely to be submitted to deformation given that their middle point along the first direction is farther away from corners of the same long flank than the middle point of a short flank from the respective short flank corners.

Figure 7:
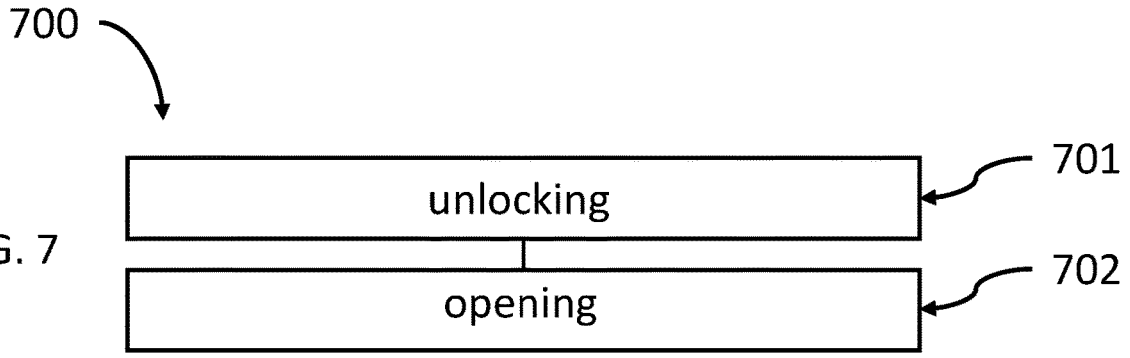
FIG. 7 illustrates a first example method.

FIG. 7 represents an example method 700 to operate a locked consumer product. The consumer product may be any example consumer product according to this disclosure. Method 700 comprises, in block 701, unlocking the container by pinching the lid with a first adult hand between a thumb of the first adult hand and one or more other fingers of the first adult hand, the one or more other fingers preferably comprising one or more of the index finger or of the middle finger, whereby the pinching takes place across the top of the lid, whereby either the thumb or the one or more other fingers apply the actuation pressure on the specific actuation area, and respectively on the additional actuation area, when present, whereby the thumb and one or more other fingers enter in contact simultaneously with the specific flank and with the flank opposite the specific flank in an area between the specific centroid, respectively additional centroid when the additional actuation are is present, and the top of the lid. Method 700 further comprises, in block 702, opening the container by sliding the pinched lid away from the box in a direction normal to the top of the lid while holding the box with a second adult hand. It should be understood that in some example, a single specific actuation area, without an additional actuation area being present, in which case pressure may be applied directly on the opposite flank in lieu of being applied on an additional actuation area. In some other examples, both the specific actuation area and the additional actuation area are provided.

Figure 8:
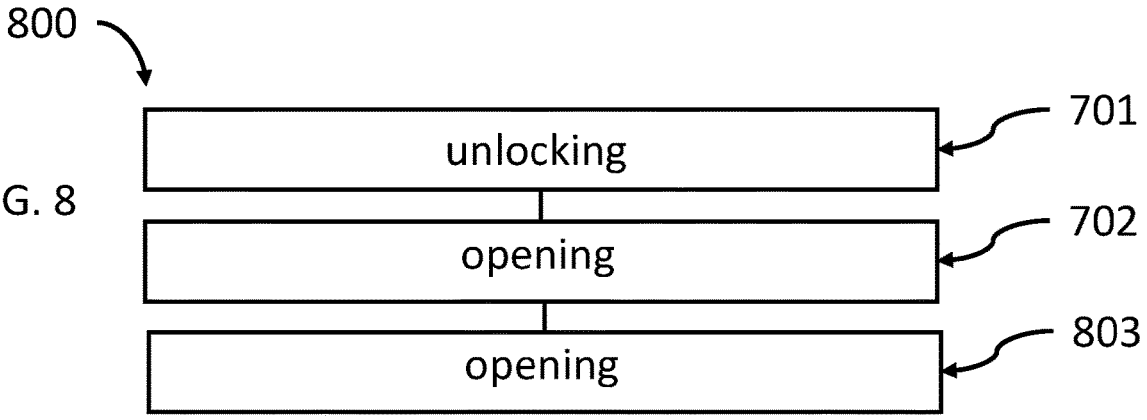
FIG. 8 illustrates a second example method.

FIG. 8 illustrates an example method 800 comprising blocks 701 and 702 as described in the context of FIG. 7. Method 800 further comprises in block 803 closing the container by placing the lid on the box until the lid is in the locked position. In some examples, an audible click is produced when the lid gets locked, confirming that locking took place.

Combinations

A. A consumer product comprising a detergent product and a container, the container comprising a box, a lid for the box, and a lock to maintain the lid in a closed position, the box comprising the detergent product, the box comprising a base, sidewalls and an opening opposite the base, the lid comprising a top and flanks, the top covering the opening and the flanks covering at least a specific portion of a specific sidewall of the sidewalls of the box when the lid is in the closed position, the lock comprising a specific actuator moveable from a locking position to an opening position by applying an actuation pressure onto the specific actuator when the lid is in the closed position, the specific actuator being connected to the specific portion, the flanks comprising a specific actuation area in a specific flank, the actuation area facing the specific actuator and permitting displacing the specific actuator from the locking position to the opening position by applying the actuation pressure at the specific actuation area when the lid is in the closed position, whereby:
   - the specific actuation area spans less than about 8 $cm^2$ and more than about 0.2 $cm^2$, the specific actuation area defining a specific centroid;
   - the specific centroid is separated from the top of the lid by less than about 5 cm and by more than about 0.5 cm;
   - the specific centroid is separated from a distal end of the specific flank by more than about 0.5 cm; and
   - the top of the lid spans less than about 13 cm and more than about 6 cm along a direction normal to the specific portion at the specific centroid.

B. The consumer product according to paragraph B, the flanks comprising an additional actuation area in an opposite flank, the opposite flank being opposite the specific flank, the additional actuation area being adjacent to an additional portion of a sidewall opposite the specific sidewall, whereby:
   - the additional actuation area spans less than about 8 $cm^2$ and more than about 0.2 $cm^2$, the additional actuation area defining an additional centroid;
   - the additional centroid is separated from the top of the lid by less than about 5 cm and by more than about 0.5 cm;
   - the specific centroid is separated from a distal end of the opposite flank by more than about 0.5 cm;
   - the additional centroid is aligned with the specific centroid along a direction normal to the additional portion at the additional centroid; and
   - the additional centroid and the specific centroid are separated by more than about 6 cm and by less than about 13 cm.

C. The consumer product according to paragraph B, whereby a shortest distance between the additional centroid and the specific centroid along the specific flank, top of the lid and opposite flank is of less than about 18 cm.

D. The consumer product according to paragraph B, whereby the lock comprises an additional actuator, the additional actuator being connected to the additional portion of the sidewall opposite the specific sidewall, the additional actuator facing the additional actuation area.

E. The consumer product according to paragraph A, whereby the lid comprises a transversal support element extended from a first end of the support element to a second end of the support element along the direction normal to the specific portion at the specific centroid, the support element being attached or integrated to the top of the lid, whereby the specific portion is located between the first end and the specific actuation area when the lid is in the closed position, the first end being separated from the specific actuation area by a clearance of less than about 1 cm and of more than about 0.5 mm along the direction normal to the specific portion at the specific centroid.

F. The consumer product according to paragraph E, whereby the additional portion is located between the second end and the additional actuation area when the lid is in the closed position, the second end being separated from the additional actuation area by a clearance of less than about 1 cm and of more than about 0.5 mm along a direction normal to the additional portion at the additional centroid.

G. The consumer product according to Paragraph A, whereby one or more of the actuation areas is an aperture.

H. The consumer product according to Paragraph G, whereby the detergent product is in the form of unit dose detergent pouches, whereby the aperture is configured to prevent a unit dose detergent pouch from passing through the aperture.

I. The consumer product according to paragraph G, whereby the specific portion, respectively additional portion, comprises a visual indication visible through the aperture, respectively apertures, when the lid is closed.

J. The consumer product according paragraph A, whereby one or more flank of the flanks comprising a respective actuation area covers at least about 30% of one or more respective sidewall of the sidewalls when the lid is in the closed position.

K. The consumer product according to paragraph A, whereby the lid may be entirely separated from the box when open, and whereby the lid weighs less than about 200 g and more than about 10 g.

L. The consumer product according to paragraph A, whereby the specific centroid is separated from the top of the lid by more than about 1 cm and by less than about 3 cm.

M. The consumer product according to paragraph A, whereby the specific centroid is located in a central region of a flank of the lid along a horizontal direction parallel to the top of the lid.

N. The consumer product according to paragraph A, whereby the specific actuation area has a circular shape.

O. The consumer product according to paragraph A, whereby the specific actuation area is less than about 6 $cm^2$ and more than about 1 $cm^2$.

P. The consumer product according to paragraph A, whereby the container is made from paper or cardboard materials.

Q. The consumer product according to paragraph A, whereby the lid comprises a corrugated cardboard layer, the corrugated cardboard layer comprising flutes.

R. The consumer product according to paragraph A, the flanks comprising two short flanks and two long flanks, whereby the specific actuation area is on a long flank.

S. A method to operate a locked consumer product, the consumer product being according to paragraph A, the method comprising:

unlocking the container by pinching the lid with a first adult hand between a thumb of the first adult hand and one or more other fingers of the first adult hand, whereby the pinching takes place across the top of the lid, whereby either the thumb or the one or more other fingers apply the actuation pressure on the specific actuation area, and respectively on the additional actuation area, whereby the thumb and one or more other fingers enter in contact simultaneously with the specific flank and with the flank opposite the specific flank in an area between the specific centroid, respectively additional centroid, and the top of the lid; and opening the container by sliding the pinched lid away from the box in a direction normal to the top of the lid while holding the box with a second adult hand.

T. The method to operate a locked consumer product according to paragraph S, the method further comprising closing the container by placing the lid on the box until the lid is in the locked position.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm". Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A consumer product comprising a detergent product and a container, the container comprising a box, a lid for the box, and a lock to maintain the lid in a closed position, the box comprising the detergent product, the box comprising a base, sidewalls and an opening opposite the base, the lid comprising a top and flanks, the top covering the opening and the flanks covering at least a specific portion of a specific sidewall of the sidewalls of the box when the lid is in the closed position, the lock comprising a specific actuator moveable from a locking position to an opening position by applying an actuation pressure onto the specific actuator when the lid is in the closed position, the specific actuator being connected to the specific portion, the flanks comprising a specific actuation area in a specific flank, the actuation area facing the specific actuator and permitting displacing the specific actuator from the locking position to the opening position by applying the actuation pressure at the specific actuation area when the lid is in the closed position, and whereby the flanks comprise an additional actuation area in an opposite flank, the opposite flank being opposite the specific flank, the additional actuation area being adjacent to an additional portion of a sidewall opposite the specific sidewall, and whereby the specific actuation area is placed so that it is not exactly opposite the additional actuation area.

2. The consumer product according to claim 1, whereby:

the specific actuation area spans less than about 8 $cm^2$ and more than about 0.2 $cm^2$, the specific actuation area defining a specific centroid;

the specific centroid is separated from the top of the lid by less than about 5 cm and by more than about 0.5 cm;

the specific centroid is separated from a distal end of the specific flank by more than about 0.5 cm; and the top of the lid spans less than about 13 cm and more than about 6 cm along a direction normal to the specific portion at the specific centroid.

3. The consumer product according to claim 1, whereby:

the additional actuation area spans less than about 8 $cm^2$ and more than about 0.2 $cm^2$, the additional actuation area defining an additional centroid;

the additional centroid is separated from the top of the lid by less than about 5 cm and by more than about 0.5 cm;

the specific centroid is separated from a distal end of the opposite flank by more than about 0.5 cm;

and the additional centroid and the specific centroid are separated by more than about 6 cm and by less than about 13 cm.

4. The consumer product according to claim 1, whereby a shortest distance between the additional centroid and the specific centroid along the specific flank, top of the lid and opposite flank is of less than about 18 cm.

5. The consumer product according to claim 1, whereby the lock comprises an additional actuator, the additional actuator being connected to the additional portion of the sidewall opposite the specific sidewall, the additional actuator facing the additional actuation area.

6. The consumer product according to claim 1, whereby the lid comprises a support element extended from a first end of the support element to a second end of the support element along the direction normal to the specific portion at the specific centroid, the support element being attached or integrated to the top of the lid, whereby the specific portion is located between the first end and the specific actuation area when the lid is in the closed position, the first end being separated from the specific actuation area by a clearance of less than about 1 cm and of more than about 0.5 mm along the direction normal to the specific portion at the specific centroid.

7. The consumer product according to claim 6, whereby the additional portion is located between the second end and the additional actuation area when the lid is in the closed position, the second end being separated from the additional actuation area by a clearance of less than about 1 cm and of more than about 0.5 mm along a direction normal to the additional portion at the additional centroid.

8. The consumer product according to claim 1, whereby one or more of the actuation areas is an aperture.

9. The consumer product according to claim 8, whereby the detergent product is in the form of unit dose detergent pouches, whereby the aperture is configured to prevent a unit dose detergent pouch from passing through the aperture.

10. The consumer product according to claim 8, whereby the specific portion, respectively additional portion, comprises a visual indication visible through the aperture, respectively apertures, when the lid is closed.

11. The consumer product according claim 1, whereby one or more flank of the flanks comprising a respective actuation area covers at least about 30% of one or more respective sidewall of the sidewalls when the lid is in the closed position.

12. The consumer product according to claim 1, whereby the lid may be entirely separated from the box when open, and whereby the lid weighs less than about 200 g and more than about 10 g.

13. The consumer product according to claim 1, whereby the specific centroid is separated from the top of the lid by more than about 1 cm and by less than about 3 cm.

14. The consumer product according to claim 1, whereby the specific centroid is located in a central region of a flank of the lid along a horizontal direction parallel to the top of the lid.

15. The consumer product according to claim 1, whereby the specific actuation area has a circular shape.

16. The consumer product according to claim 1, whereby the specific actuation area is less than about 6 $cm^2$ and more than about 1 $cm^2$.

17. The consumer product according to claim 1, whereby the container is made from paper or cardboard materials.

18. The consumer product according to claim 1, whereby the lid comprises a corrugated cardboard layer, the corrugated cardboard layer comprising flutes.

19. The consumer product according to claim 1, the flanks comprising two short flanks and two long flanks, whereby the specific actuation area is on a long flank.

20. A method to operate a locked consumer product, the consumer product being according to claim 1, the method comprising:

unlocking the container by pinching the lid with a first adult hand between a thumb of the first adult hand and one or more other fingers of the first adult hand, whereby the pinching takes place across the top of the lid, whereby either the thumb or the one or more other fingers apply the actuation pressure on the specific actuation area, and respectively on the additional actuation area, whereby the thumb and one or more other fingers enter in contact simultaneously with the specific flank and with the flank opposite the specific flank in an area between the specific centroid, respectively additional centroid, and the top of the lid; and opening the container by sliding the pinched lid away from the box in a direction normal to the top of the lid while holding the box with a second adult hand, and optionally further comprising closing the container by placing the lid on the box until the lid is in the locked position.

* * * * *